US008419423B2

(12) United States Patent
Kalugin

(10) Patent No.: US 8,419,423 B2
(45) Date of Patent: Apr. 16, 2013

(54) HOT AIR STOVE

(76) Inventor: Yakov Kalugin, Ekaterinburg (RU)

( * ) Notice: Subject to any disclaimer, the term of this patent is extended or adjusted under 35 U.S.C. 154(b) by 785 days.

(21) Appl. No.: 12/665,814

(22) PCT Filed: Jul. 9, 2007

(86) PCT No.: PCT/RU2007/000363

§ 371 (c)(1),
(2), (4) Date: Dec. 21, 2009

(87) PCT Pub. No.: WO2009/008758

PCT Pub. Date: Jan. 15, 2009

(65) Prior Publication Data

US 2010/0323314 A1 Dec. 23, 2010

(51) Int. Cl.
*C21B 9/00* (2006.01)
*C21B 7/02* (2006.01)

(52) U.S. Cl.
USPC ..... 432/214; 432/201; 122/1 A

(58) Field of Classification Search ..... 432/214, 432/217, 219, 222, 200, 201, 177; 122/1 A; 266/49, 218, 256, 262
See application file for complete search history.

(56) References Cited

U.S. PATENT DOCUMENTS

| | | | | |
|---|---|---|---|---|
| 2,338,175 | A * | 1/1944 | Gibson | 266/93 |
| 3,082,995 | A * | 3/1963 | Krapf | 432/40 |
| 3,473,793 | A | 10/1969 | Cronert | |
| 3,891,384 | A * | 6/1975 | Hovis et al. | 432/217 |
| 4,322,205 | A * | 3/1982 | Hasselquist et al. | 432/214 |
| 4,344,607 | A * | 8/1982 | Smith, Jr. | 266/198 |
| 4,478,575 | A * | 10/1984 | Hyde | 432/217 |
| 4,495,054 | A * | 1/1985 | Claflin | 75/468 |
| 4,877,013 | A * | 10/1989 | Eschmann et al. | 126/110 R |
| 5,820,814 | A * | 10/1998 | Doumet | 266/44 |

FOREIGN PATENT DOCUMENTS

| | | |
|---|---|---|
| EP | 0139255 A1 | 5/1985 |
| RU | 2145637 C1 | 2/2000 |

OTHER PUBLICATIONS

International Search Report of PCT/RU2007/000363 dated Mar. 27, 2008.

* cited by examiner

*Primary Examiner* — Gregory A Wilson
(74) *Attorney, Agent, or Firm* — Amster, Rothstein & Ebenstein

(57) ABSTRACT

The inventive air heater comprises a housing (1) with a lining (2), a nozzle (3), a dome (5) with a prechamber (6), which is coaxially positioned in the top part thereof and is provided with a housing (7) and a lining (8) provided with an independent support (9) on the housing (7). Gas (11) and air (12) channels are made in the side vertical wall of the prechamber (10) lining and are connected to internal manifolds (14,15) and to gas (16) and air (17) supplying sleeve fittings. The channels of the lower manifold (15) are arranged in the top part thereof and are upwardly oriented at and angle of 15-30° with respect to a horizontal plane. The channels of the top manifold (14) are arranged in the lower part thereof and are downwardly oriented at an angle of 15-30° to a horizontal plane. The projections of all the channels on a horizontal plane form an angle of 15-45° to the projections of the prechamber radii, passing over the centers of the outlet sections of the channels (11, 12), on a horizontal plane. The use of the invention makes it possible to reduce operation costs and to improve gas burning.

1 Claim, 2 Drawing Sheets

HOT AIR STOVE

ART

The invention concerns to the area of ferrous metallurgy, in particular to the construction of air heaters for heating up air blast of blast furnaces.

FORMER LEVEL OF TECHNIQUE

Air heaters without combustion chamber (shaftless) and with installation of burner devices or prechambers on the dome of the air heater (Patent of Russia No. 2145637, Certificate of Authorship No. 602555, Patent of Japan No. 48-4284, U.S. Pat. No. 3,473,794) are known, which are more perspective.

The closest invention to the proposed one for technical character and combination of features is shaftless air heater according to Patent of Russia No. 2145637, class C21B 9/02 (prototype). It has a shell with brick-lining, checkerwork, dome, hot blast connecting pipe, located above the checkerwork on distance up to its axis not less than one diameter of its flow area and also a prechamber, located in the upper part of the dome coaxially with it and having a shell with brick-lining, executed independently of dome brick-lining with an independent support on a prechamber shell. In the prechamber there are ring collectors of gas and air which are located between shell and brick-lining side wall of the prechamber one above another and are divided by a separating wall. Collectors have inlet connecting pipes and outlet channels, the latter are executed in the vertical side wall of the prechamber brick-lining and therefore the output of gas and air occurs directly into prechamber. At the expense of the fact that the axes of channels of the upper row from the bottom collector are directed to the axis of the prechamber and shifted upwards from a horizontal plane at the angle up to 30 degrees, and axes of all other channels are located in a horizontal plane and directed at the angle of 15-30 degrees to radiuses of prechamber, passing through the centers of their outlet sections, in the prechamber the vortex of gas and air flows are formed. The vortex of gas and air flows provides full burning of gas up to the inlet into the checkerwork and uniform flow distribution along the checkerwork.

Blast furnace air heaters are large-sized high-temperature units and require great expenses for their construction and operation. Therefore one of the basic requirements to them is decrease of energy expenditures. In addition, air heaters burn great amount of blast furnace gas which structure includes poisoning gas—carbon oxide "CO". Therefore an important requirement at operation of blast furnace air heaters is full burning of gas, which will provide their ecological safety.

In connection with the above mentioned the known air heater has a number of disadvantages.

To guarantee good mixing and combustion of gas and air in the prechamber the vortex of flows is created. Gas is supplied into the upper part of the prechamber and vortex of flows is formed here. To enable good mixture of gas and air in the known air heater it is foreseen to direct the air channels axes of the upper part of the bottom collector along the radius to the prechamber axis and shift upwards from the horizontal plane at the angle up to 30 degrees. It is supposed, that directed along radius and shifted upwards air jets should pass through a flow of gas to the central part of prechamber and provide good mixture and combustion of gas in the center of prechamber. Jets of air from channels of other rows are directed at the angle to radiuses of prechamber and should provide good mixture and combustion of peripheral flows of gas. However prechambers have large lateral dimensions at air heaters of large blast furnaces and in order to pass to the prechamber axis air jets of the upper row should pass through the vortex of gas flow of significant thickness. For this purpose it is necessary to increase considerably their velocities and to install more powerful air-blower that will increase power expenses. Besides there can be an incomplete combustion of gas in the central part of prechamber, that will lead to deterioration of ecological parameters of air heaters. Thus there is a contradiction. On the one hand, for increase penetrating capacity of air jets of the upper row it is necessary to increase considerably their velocity, and consequently also pressure in the collector that will demand application of much more powerful air-blower. On the other hand, for air jets from the remaining channels velocities increase is not required as in peripheral parts of prechamber at usual velocities and vortex of flows a good mixture and full combustion of gas up to the inlet into the checkerwork is provided.

Thus, for channels of the different rows coming out of one collector, different pressures in this collector are required what is impossible to provide. As for maintenance of air pressure in the collector the air-blowers with usual pressure are installed, then velocity of jets from upper row channels appears insufficient and not sufficient amount of air is supplied into the center of prechamber which is required for full burning of gas. Thereof this part of gas has not been burnt out completely and is thrown out into the atmosphere, what deteriorates ecological characteristics of air heater.

DISCLOSURE OF THE INVENTION

The present invention is based on the task to decrease operational expenses and improve burning of gas, which can be reached by means of redistribution of flows of gas and air in the prechamber.

The decision of the given task is reached by that, according to the invention, in the known air heater, containing shell with brick-lining, checkerwork, dome, hot blast connecting pipe, located over checkerwork on distance of its axis not less then one diameter of its flow area section and prechamber, located in the upper part of the dome coaxially with it and having shell with brick-lining, executed independently from dome brick-lining with an independent support on the prechamber shell, collectors of gas and air with a separating wall between them, located between shell and side wall of the prechamber brick-lining one above another and having connecting pipes and the outlet channels executed in the vertical side wall of prechamber brick-lining, outlet channels of the bottom collector are located in its upper part and are directed upwards from a horizontal plane at the angle of 15-30 degrees, and outlet channels of the upper collector are located in its bottom part and directed downwards from a horizontal plane at the angle of 15-30 degrees, and projections of axes of the specified channels to a horizontal plane form an angle of 15-45 degrees to projections to a horizontal plane of radiuses of prechamber, passing through the center of outlet sections of channels.

The execution of the outlet channels in the prechamber, going out of the bottom collector, which are located above and directed upwards at the angle of 15-30 degrees, and outlet channels of the upper collector, located below and directed downwards at the angle of 15-30 degrees, it is possible to direct jets of gas and air towards each other so further they can move in the one way direction vortex of flow, penetrating each other. Flows of air do not need to overcome the jet vortex of gas of the big thickness to get to the center of prechamber since they get there together with jets of gas. High velocities of air jets and air-blowers with high pressure are not required also. The arrangement of projections of axes of all channels on a horizontal plane under the angle of 15-45 degrees to projections to a horizontal plane of radiuses of prechamber, passing through the centers of their outlet cross sections, allows to create required high degree of jet vortex of gas and air of the outlet channels that provides, on the one hand, full combustion of gas before the inlet into the checkerwork and, on the other hand, a uniform entrance of the flow into the checkerwork.

As a result of such constructive execution at air heaters of blast furnaces of both small and large volume full combustion of gas before inlet into the checkerwork and uniform entrance of combustion products into the checkerwork is provided under decrease in power expenses with maintenance of ecologically clean combustion products.

BRIEF DESCRIPTION OF FIGURES

The essence of the invention is explained by graphic materials where it is presented.

THE BEST VARIANT OF REALIZATION OF THE INVENTION

Figure 1:
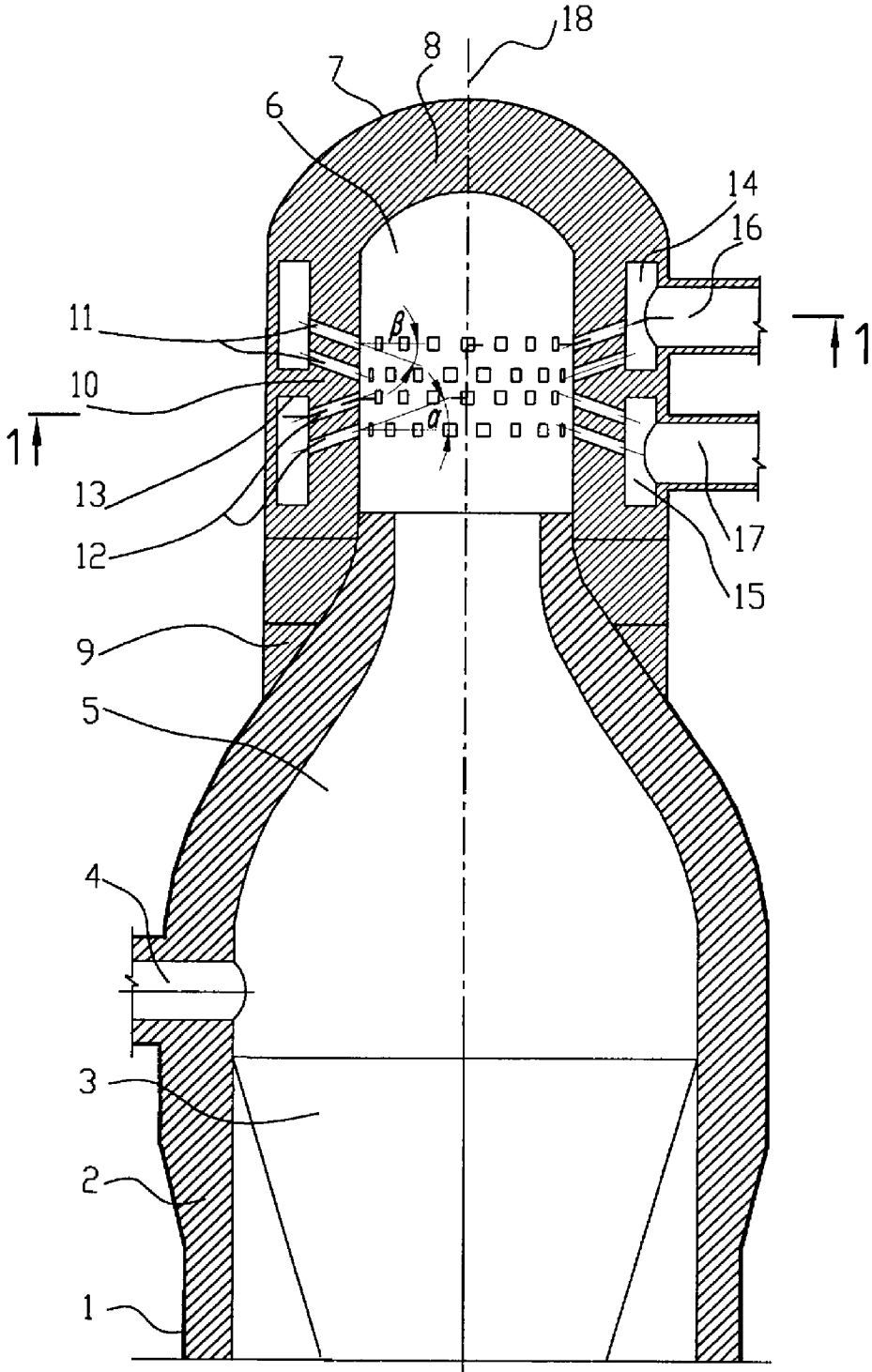
FIG. 1 a general view of one of possible variants of execution of the shaftless air heater of the offered design, a vertical section where gas and air supply connecting pipes and hot blast connecting pipe are conditionally placed in one plane.
Figure 2:
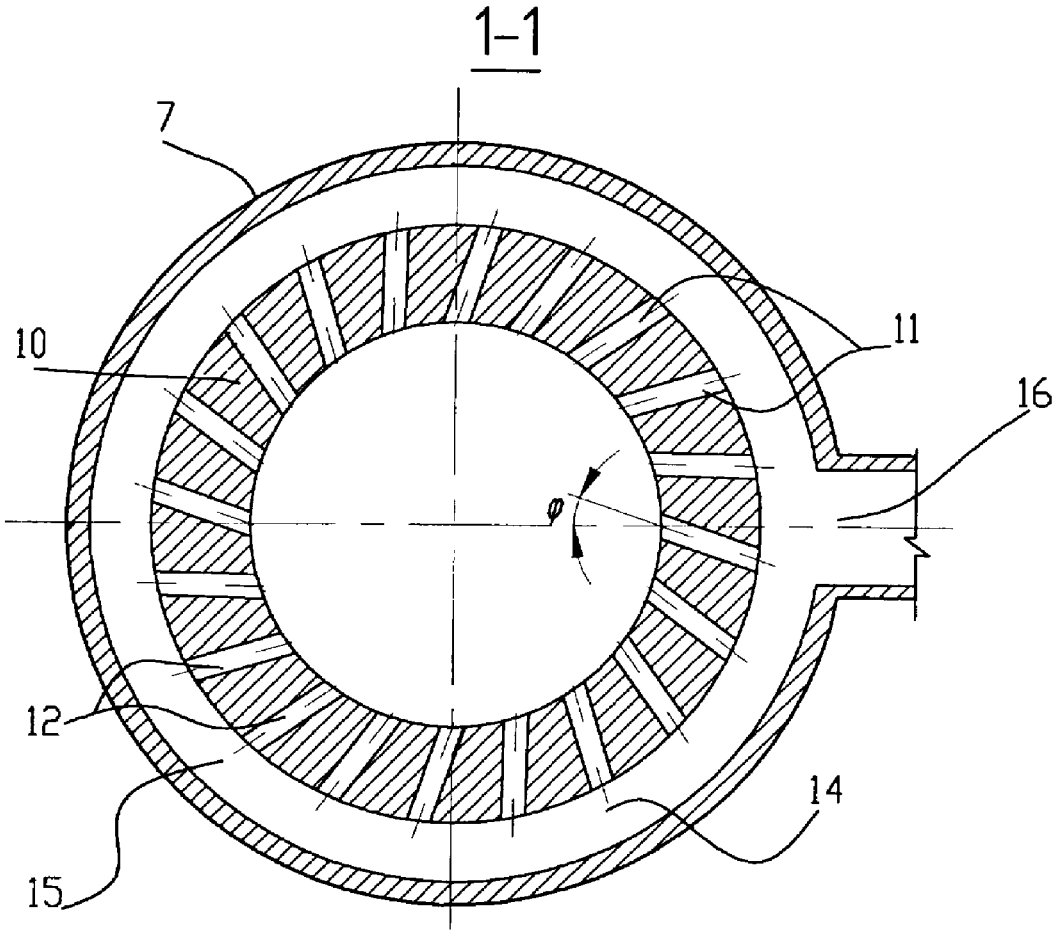
FIG. 2 section I-I on FIG. 1.

Air heater contains a shell 1 with brick-lining 2, checkerwork 3, hot blast connecting pipe 4, dome 5 with prechamber 6, located at its top, coaxial to it, having shell 7 and brick-lining 8, executed independently of the dome brick lining with an independent support 9 on the shell. The hot blast connecting pipe 4 is located above checkerwork 3 on distance up to its axis not less than 1 diameter of its flow area section. In the vertical wall of the prechamber channels for passing of gas 11 and air 12 are executed, interconnecting with internal collectors 14 and 15, with a separating wall 13 between them and connecting pipes 16 and 17 of gas and air supply. Channels 12 of the bottom collector 15 are located at the top of the collector and directed upwards from horizontal plane at the angle $\acute{\alpha}$=15-30 degrees. Channels 11 of the top collector 14 are located in the bottom of a collector and directed downwards from a horizontal plane at the angle $\beta$=15-30 degrees. Projections of all channels to the horizontal plane form the angle $\phi$=15-45 degrees to projections to the horizontal plane of radiuses of prechamber, passing through the center of outlet sections of channels. It is preferable, that gas is supplied into the top collector, and air—into the bottom collector, as it is shown on FIG. 1. However supply can be also reverse.

Described air heater contains essential differences operates as follows:

During heating up of checkerwork air for combustion is supplied through the branch pipe 17 to the air collector 15 located inside of air heater between shell and brick-lining of the prechamber under gas collector 14, and through outlet channels 12 in the vertical wall of brick-lining 10 is supplied into prechamber. Jets of air from channels 12 are directed upwards. Gas is supplied to the gas collector 14 through the branch pipe 16, located inside the air heater between shell and prechamber brick-lining above the air collector 17, and then gas is supplied into prechamber through the outlet channels 11 located in the vertical wall 10 of brick-lining. Jets of gas from channels 11 are directed downwards, towards to jets of air. As a result there is a mutual penetration of jets of gas into the jets of air and joint movement of gas and air in one way flow direction from prechamber periphery to the center. Air does not need to pass through the vortex of gas flow of significant thickness anymore and it moves to the center of prechamber together with a flow of gas. The output of both flows from the outlet channels located at the angle $\phi$=of 15-45 degrees to prechamber radiuses, creates vortex of flows in one direction, that in addition improves mixing of gas and air. At merge of flows of gas and air there occurs ignition of the air-gas mixture from preheated brick-lining of prechamber. Intensive mixing of gas and air in one vortex of flow leads to fast gas combustion, which starts in the prechamber and finished in the inlet into the conical part of the dome.

During blast period the cold blast is supplied into the checkerwork 3 bottom-up and, passing upwards, is heated up. Heated blast is supplied into the area under the dome 5 and is branched out by means of hot blast connecting pipe 4 to the consumer, for example, to the blast furnace. During blast period, due to high temperature of the hot blast, brick lining temperature in the prechamber is kept, which is sufficient for combustion of gas and air mixture at the beginning of the gas period.

Thus, because during the gas period intensive mixing and combustion of gas and air in the prechamber is organized, jets of which move into the one way direction vortex of flows, full combustion of gas before inlet into the checkerwork is reached at decrease in power expenses providing ecologically clean combustion products at air heaters of blast furnaces both of small, and large volume.

Industrial Applicability

The invention can be used not only in ferrous metallurgy for blast heating of blast furnaces, but also in power engineering for heating of heat-carriers (air, gas) up to high temperatures.

The invention claimed is:

1. Air heater, containing shell (1) with brick-lining (2), checkerwork (3), dome (5), hot blast connecting pipe (4) located above checkerwork (3) on distance up to its axis not less of one diameter of its flow area section, prechamber (6), located in the top part of the dome (5) coaxially with it and having shell (7) with brick-lining (8), executed independently of dome brick-lining with an independent support (9) on the prechamber shell, gas (14) and air (15) collectors with a separating wall (13) between them, located between shell (7) and the side wall of prechamber brick-lining (10) one above another and having inlet connecting pipes (16,17) and the outlet channels (11,12) executed in the vertical side wall of prechamber brick-lining (10), differing that outlet channels (12) of bottom collectors (15) are located in its top part and directed upwards from the horizontal plane at the angle of 15-30 degrees, and outlet channels (11) are located in its bottom part and directed downwards from the horizontal plane at the angle of 15-30 degrees, projections of axes of the specified channels to the horizontal plane form an angle of 15-45 degrees to projections to the horizontal plane of prechamber radiuses, passing through the center of outlet sections of channels (11, 12).

* * * * *